US009144830B2

(12) United States Patent
Takayanagi

(10) Patent No.: US 9,144,830 B2
(45) Date of Patent: Sep. 29, 2015

(54) STATIC ELIMINATING AND DUST REMOVING APPARATUS

(71) Applicant: TRINC Corporation, Hamamatsu, Shizuoka-pref (JP)

(72) Inventor: Makoto Takayanagi, Hamamatsu (JP)

(73) Assignee: TRINC Corporation, Hamamatsu, Shizuoka-prefecture (JP)

( * ) Notice: Subject to any disclaimer, the term of this patent is extended or adjusted under 35 U.S.C. 154(b) by 62 days.

(21) Appl. No.: 14/031,673

(22) Filed: Sep. 19, 2013

(65) Prior Publication Data

US 2014/0082865 A1 Mar. 27, 2014

(30) Foreign Application Priority Data

Sep. 21, 2012 (JP) ..... 2012-208474
Aug. 2, 2013 (JP) ..... 2013-161001

(51) Int. Cl.

| | |
|---|---|
| ***B08B 6/00*** | (2006.01) |
| ***B08B 7/00*** | (2006.01) |
| ***B08B 5/00*** | (2006.01) |
| ***B08B 5/02*** | (2006.01) |
| ***B08B 15/04*** | (2006.01) |
| *B08B 5/04* | (2006.01) |
| *A47L 5/14* | (2006.01) |

(52) U.S. Cl.

CPC ... *B08B 6/00* (2013.01); *B08B 5/00* (2013.01); *B08B 5/02* (2013.01); *B08B 15/04* (2013.01); *A47L 5/14* (2013.01); *B08B 5/043* (2013.01); *B08B 5/046* (2013.01)

(58) Field of Classification Search

CPC ..... B08B 5/00; B08B 5/04; B08B 5/043; B08B 5/046; B08B 6/00; B08B 7/00; B08B 7/02; B08B 7/026; B08B 7/028; B08B 7/04; A47L 5/00; A47L 5/14; A47L 7/00; A47L 7/04; A47L 9/00; A47L 9/02; A47L 9/08

USPC ..... 15/1.51, 300.1, 301, 303, 306.1, 309.1, 15/345, 346, 415.1

See application file for complete search history.

(56) References Cited

U.S. PATENT DOCUMENTS

| | | | | |
|---|---|---|---|---|
| 3,395,042 | A * | 7/1968 | Herbert, Jr. | 134/1 |
| 4,026,701 | A * | 5/1977 | Till et al. | 430/119.8 |
| 4,454,621 | A * | 6/1984 | Testone | 15/1.51 |
| 4,677,704 | A * | 7/1987 | Huggins | 15/1.51 |
| 5,231,622 | A * | 7/1993 | Hayashi | 369/73 |
| 2010/0089015 | A1 * | 4/2010 | Takayanagi | 55/431 |

FOREIGN PATENT DOCUMENTS

| | | |
|---|---|---|
| JP | 2005-302319 | * 10/2005 |
| JP | 2010-088751 | 4/2010 |

* cited by examiner

*Primary Examiner* — Mark Spisich
(74) *Attorney, Agent, or Firm* — Leighton K. Chong

(57) ABSTRACT

The static eliminating and dust removing apparatus comprises a big container and a small container disposed within the big container. The big container opens at the top and bottom ends to suck the dust in upwardly and discharge the dust. The small container is of hollow cylindrical or truncated conical structure and of a construction that the cyclone and tornado are generated within the small container. Furthermore, the static eliminating and dust removing apparatus has an ion generator disposed in the small container for generating ions which is injected or introduced in the small container and a dried compressed air injection opening formed on the small container for injecting the dried compressed air into the small container to generate cyclone and tornado within the small container.

6 Claims, 12 Drawing Sheets

⊕ AIR STREAM FROM FRONT TO REAR OF DRAWING

⊙ AIR STREAM FROM REAR TO FRONT OF DRAWING

UPWARD AIR STREAM FROM FRONT TO REAR OF DRAWING

DOWNWARD AIR STREAM FROM FRONT TO REAR OF DRAWING

UPWARD AIR STREAM FROM REAR TO FRONT OF DRAWING

DOWNWARD AIR STREAM FROM REAR TO FRONT OF DRAWING

STATIC ELIMINATING AND DUST REMOVING APPARATUS

TECHNICAL FIELD

This invention relates to a static eliminating and dust removing apparatus in which extraneous material such as dust attached to the work is separated from the work, static is removed from the dust and thus the dust is removed from the work.

BACKGROUND OF INVENTION

In the conventional invention described in the Japanese Patent Publication 2010-088751, the container is disposed above the moving work and a compressed air including ions is injected into the container to generate a cyclone and negative pressure so as to separate dust from the work. Thus the dust is separated from the work in a non-contact state.

REFERENCES OF PRIOR ART

Patent Reference

[Patent reference 1] Japanese Patent Publication 2010-088751

SUMMARY OF INVENTION

The Subject to be Solved by the Invention

Although in the conventional art the dust the size of which is bigger than 20 micron can be removed from the work, the ultra fine particle of dust the size of which is around 1 micron cannot be removed from the work.

Therefore, it is an object of the invention to provide a static eliminating and dust removing apparatus in which the ultra fine particle of dust the size of which is around 1 micron can be removed from the work.

Means of Solving Subject

To accomplish the object, there is provided a static eliminating and dust removing apparatus which comprises a big container having an opened bottom portion and an opened uppermost portion for sucking dust upwardly and discharging dust, a small container of hollow cylindrical form or truncated conical form provided within said big container, said small container being constructed so that cyclone and tornado are generated within said small container, at least one ion generator disposed above or within said small container to supply ions, said small container being provided with compressed air injection openings through which a compressed air is injected into said small container to generate cyclone and tornado within said small container.

Furthermore, the static eliminating and dust removing apparatus according to the present invention has following features:

The dust can be effectively removed by enhancing the speed of air stream of cyclone, The dust can be effectively removed by approaching the small container to the work, The dust removed from the work can be effectively collected, The efficiency of dust removal is enhanced by feeding the dust thus collected back to the small container, The dust attached to the work away from the small container can be removed, The suction power is intensified to bring the work toward the small container, The electric field emitted from the discharge needles for generating air ions can be blocked, The removal of dust from opposite edges of the work in a direction of movement can be effectively made, and The dust can be removed by using electrostatic force.

Effects of the Invention

According to the invention, static and the ultra fine particle of dust can be removed from the work in a non-contact state.

Other objects, features, and advantages of the present invention will be explained in the following detailed description of the invention having references to the appended drawings:

DETAILED DESCRIPTION OF THE INVENTION

The static eliminating and dust removing apparatus according to the present invention comprises a big container and a small container disposed within the big container. The big container opens at the top and bottom ends to suck the dust in upwardly and discharge the dust. The small container is of hollow cylindrical or truncated conical structure and of a construction that the cyclone and tornado are generated within the small container. Furthermore, the static eliminating and dust removing apparatus has an ion generator disposed in the small container for generating ions which is injected or introduced in the small container and a dried compressed air injection opening formed on the small container for injecting the dried compressed air into the small container to generate cyclone (cyclone stream) and tornado (tornado stream) within the small container. It is preferable that ultrasonic generators are disposed outside of or within the small container to give vibration to the dust so as to separate the dust from the work.

First Embodiment

Figure 1:
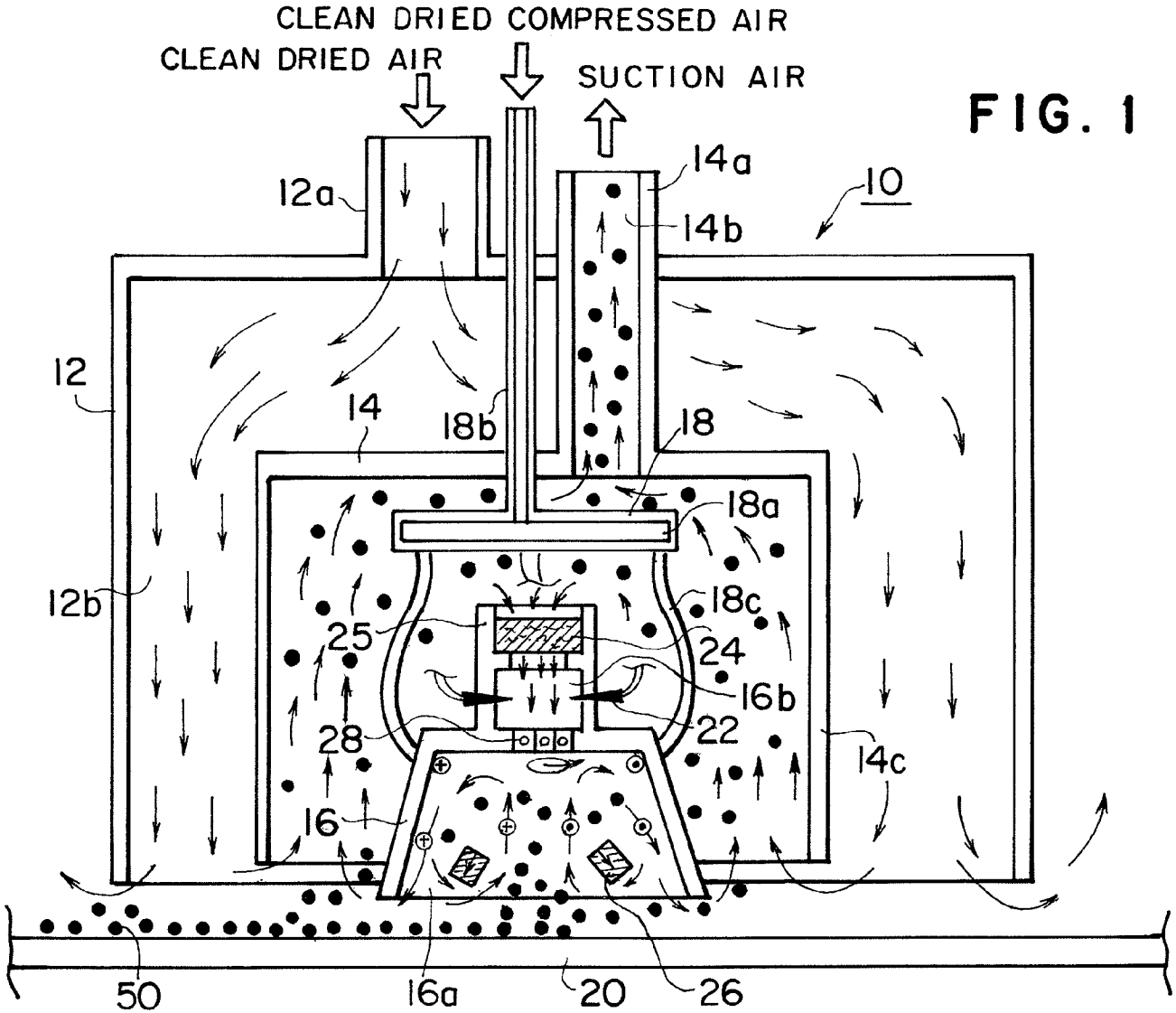
FIG. 1 is a diagrammatic cross-sectional view showing a first embodiment of a static eliminating and dust removing apparatus as a whole according to the present invention.

The first embodiment will be explained with reference to FIG. 1. In FIG. 1, a housing 12 of biggest size is disposed above the work 20 moving in a horizontal direction. The housing 12 is formed with a cylindrical feed opening 12*a* at its upper portion. A big container 14 of smaller diameter than that of the housing 12 is disposed within the housing 12 and positioned above the work 20. Thus, a flow path 12*b* is formed between the housing 12 and the big container 14, and a clean dried air is supplied from a source of clean dried air, not shown, through the feed opening 12*a* into the flow path 12*b* and discharged from the housing 12 at the bottom thereof. The work includes a film, a sheet, a plate, a glass, a cloth, a paper or the like.

The big container 14 is provided at its upper portion with a cylindrical discharge opening 14*a* in which a flow path 14*b* is formed. The discharge opening 14*a* is connected with a source of suction, not shown. A small container 16 of smaller diameter than that of the big container 14 is disposed within the big container 14 and positioned above the work 20. Thus a flow path 14*c* is formed between the big container 14 and the small container 16.

The small container 16 is of hollow cylindrical form or truncated conical form. The truncated conical small container is shown in FIG. 1. A cyclone chamber for generating a cyclone and a tornado is formed within the small container 16. Although the above-mentioned chamber generates both a cyclone and a tornado, this chamber is merely called a cyclone chamber. The small container 16 is integrally formed at its upper portion with a hollow cylindrical member 25 which supports discharge needles 22 of an ion generating device and further supports a filter 24 above the needles. The air is shown to be taken into the filter 24 from the big container 14, the air may be taken in from the housing 12 or from the outside, not shown.

A distributor 18 is disposed between the big container 14 and the small container 16 in a vertical direction to distribute a clean dried compressed air (hereinafter, merely called compressed air) from a source of clean dried compressed air, not shown, into the small container 16. The distributor 18 comprises a body 18*a*, a hollow cylindrical member 18*b* and a plurality of tubes 18*c*.

The compressed air is injected or supplied into the upper portions of small container 16 through injection openings 17 of the small container 16 along the inner wall or in a tangential direction of the inner wall. As a result, a cyclone which spirally circles along the inner wall and at the same time moves downwardly is generated. In parallel with generation of cyclone, a negative pressure is generated within the small container 16 and as a result a tornado which spirally circles at the center of small container and at the same time moves upwardly is generated. In FIG. 1, +O, dot O, +O with arrow, and dot O with arrow shows the directions of air.

Ultrasonic generators 26 for generating an ultrasonic wave and striking the same onto the work are provided within the small container 16 and a grid type of grounded earth 28 is provided at the upper portion of the small container 16.

Now, the operation of static eliminating and dust removing apparatus will be explained:

1) The compressed air is injected into the hollow cylindrical or truncated conical small container 16 at the upper portion thereof through the compressed air injection openings 17. When the air is injected in a tangential direction of inner wall, a cyclone is generated within the small container.
2) The cyclone circles while moving downwardly and is blown out at the bottom portion of the small container in a horizontal direction.
3) By the cyclone, the downward air stream which circles together with the cyclone is generated.
4) A negative pressure is generated within the small container, as a result a tornado which circles toward the negative pressure from the lower portion of the small container.
5) In the meanwhile the ions generated by the ion generator are supplied within the small container due to the negative pressure.
6) When the work 20 attached with dust 50 approaches to the apparatus, the dust is blown by the cyclone including ions in a horizontal direction.
7) At the same time the ultrasonic wave emitted by the ultrasonic vibrator cause the work and the dust to jump up or moves up and down.
8) At the moment when the dust is a little bit floats above the work, that is, separated from the work, ions get through between the work and the dust. As a result, the static of the dust is neutralized to get rid of attraction power between the work and the dust.
9) The dust which reaches the central portion of small container is sucked up due to the negative pressure generated by the tornado to fly high in.
10) The static is completely removed from the flied dust and thus the attraction power disappears.
11) The dust is again blown by the cyclone including ions in a horizontal direction.
12) The dust which is discharged from the small container is sucked through the flow path 14*b* between the big container and the small container and collected.

13) A clean dried air is supplied around the big container to prevent a portion of the dust which overcomes the negative pressure from leaking outside.

Second Embodiment

Figure 2:
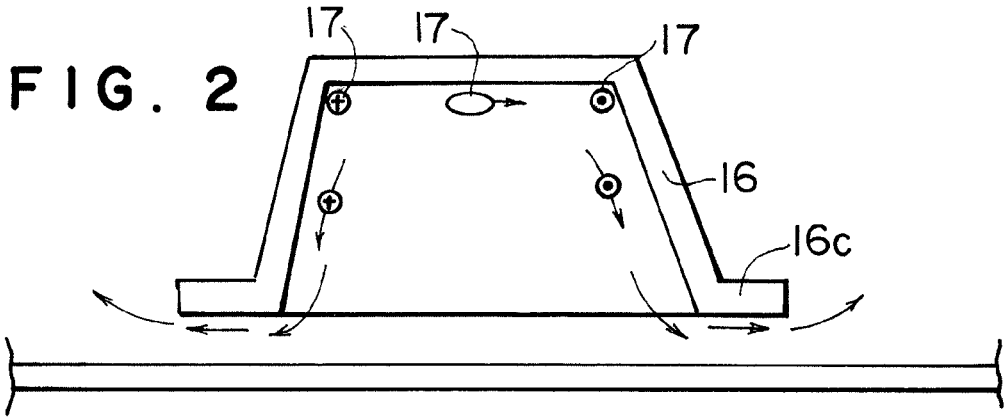
FIG. 2 is a cross-sectional view for the second embodiment of a small container used in the static eliminating and dust removing apparatus.

In the embodiments explained later, the explanation will be made with reference to the figures in which only main altered structures are shown to simplify the figures and explanations. The second embodiment will be explained with reference to FIG. 2. In FIG. 2, the small container 16 is provided with skirt portion 16*c* at its bottom portion. The skirt portion assists in the long blow of cyclone in a horizontal direction to enhance dust removing performance.

Figure 3:
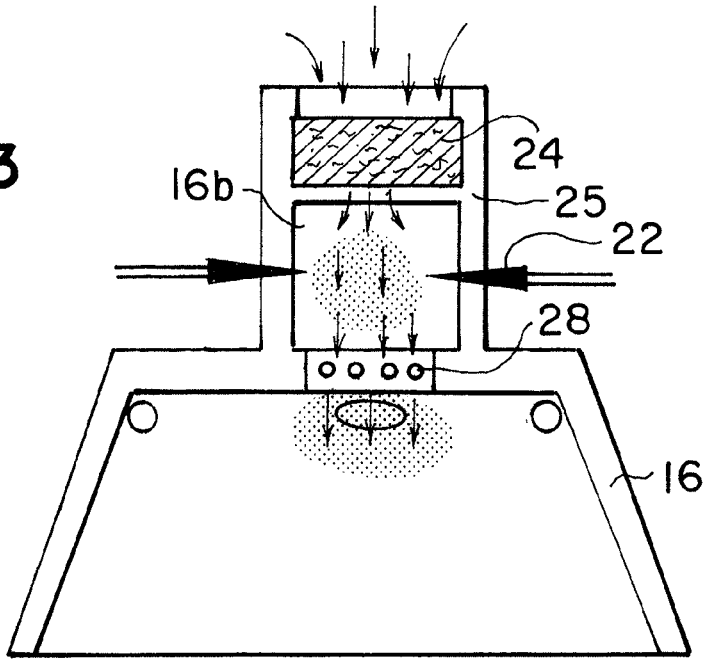
FIG. 3 is an enlarged cross-sectional view for showing the small container used in the static eliminating and dust removing apparatus.

Now the ion generator will be additionally explained with reference to FIG. 3. The ions which are generated by corona discharge of the discharge needles 22 of the ion generator is sucked into the small container 16 due to the negative pressure within the small container 16. The filter 24 is disposed above the ion chamber 16*b* to prevent the dust from entering in from the outside.

Third Embodiment

Figure 4:
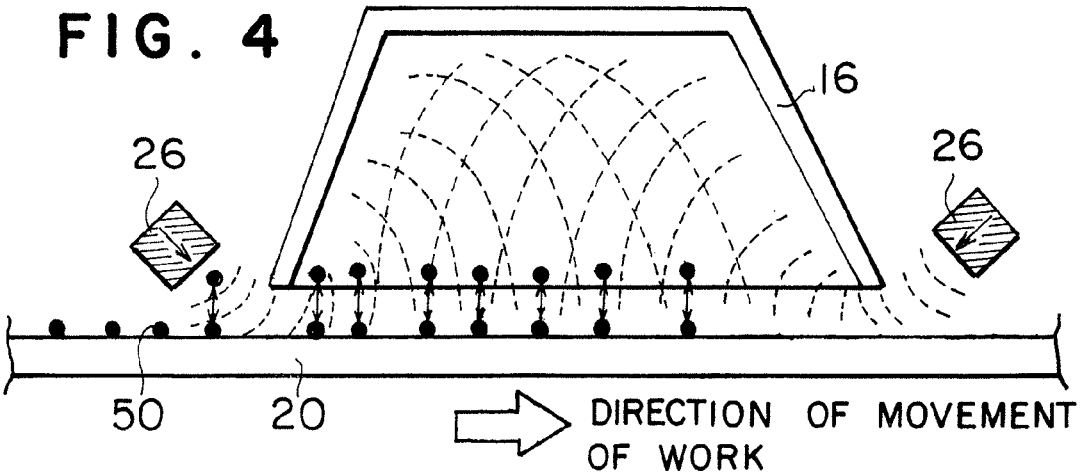
FIG. 4 is a view for explaining about the function of the third embodiment of ultrasonic wave generator used in the static eliminating and dust removing apparatus.

The third embodiment will be explained with reference to FIG. 4. Deferent from the first embodiment, FIG. 4 shows that the ultrasonic vibrators are disposed outside of the small container. The ultrasonic vibrators 26 emit ultrasonic waves toward the inside of the small container from the bottom portion of the small container. In that case, it is preferable that the angle of incidence of ultrasonic wave to the work is within 45 degree angle + or −30 degree angle. The ultrasonic wave generates standing wave within the small container due to reflections from many portions of inner wall of the small container so that the dust is caused to jump up and down with large energy. It is preferable that the frequency of ultrasonic wave is made to sweep to jump the dust of many sizes.

Figure 5:
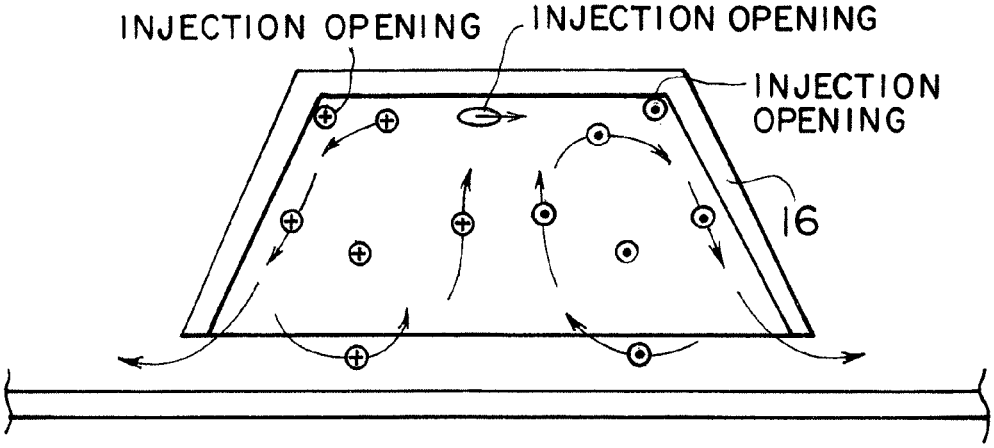
FIG. 5 is a view for explaining cyclone and tornado generated in the small container used in the static eliminating and dust removing apparatus.

The cyclone and tornado which are generated in the small container 16 will be additionally explained. FIG. 5 shows the downward cyclone, the upward tornado and the cyclone which does not move up and down, in the small container 16. When the air is injected into the small container at its upper portions in a tangential direction relative to the wall of the small container, the cyclone is generated in the small container. The cyclone moves downward while spirally circling along the inner wall surface, and finally is discharged outside at its opened bottom portion of the small container.

Due to the cyclone, the air inside of the small container circles and starts to move downward. As a result, the negative pressure is generated in the upper portion of the small container. The negative pressure sucks up the air from the bottom portion of the small container. As the result of the circulation of cyclone, the tornado in the spiral form is generated and a strong upward circling air is generated.

Figure 6:
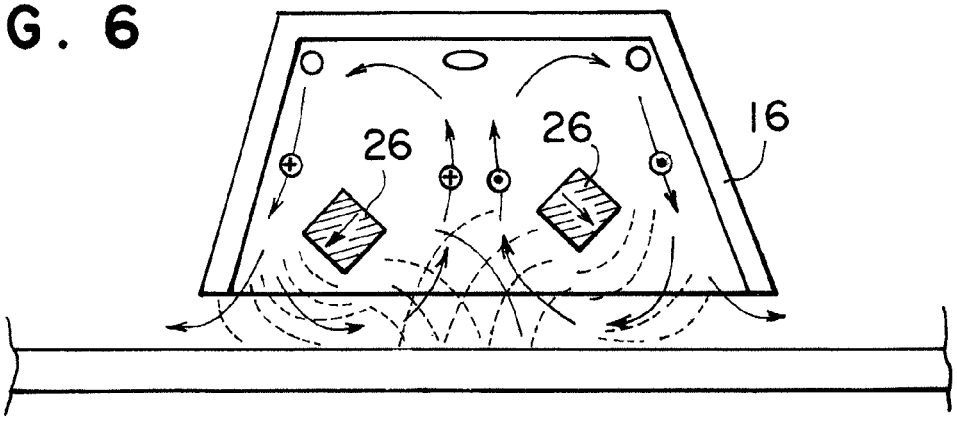
FIG. 6 is a view for explaining about the function of ultrasonic wave generator disposed within the small container used in the static eliminating and dust removing apparatus.

The first embodiment will be additionally explained with reference to FIG. 6. FIG. 6 shows the ultrasonic vibrator disposed within the small container. As mentioned above, when the air is injected into the small container at its upper portions in a tangential direction relative to the wall of the small container, the cyclone is generated in the small container. The cyclone moves downward while spirally circling along the inner wall surface, and finally is discharged outside at its opened bottom portion of the small container. Due to the cyclone, the air inside of the small container circles and starts to move downward. As a result, the negative pressure is generated in the upper portion of the small container. The negative pressure sucks up the air from the bottom portion of the small container. As the result of the circulation of cyclone, the tornado in the spiral form is generated and a strong upward circling air is generated.

In the meanwhile, an immobile circling air which does not move upward and downward is generated at the interface between the downward cyclone along the inner wall of the small container and upward tornado around central axis. It is preferable that the ultrasonic vibrators are positioned at that interface. At that position the ultrasonic vibrators are not affected by the cyclone and the tornado, and can effectively cause the dust to jump up and down in a near distance.

4th Embodiment

Figure 7:
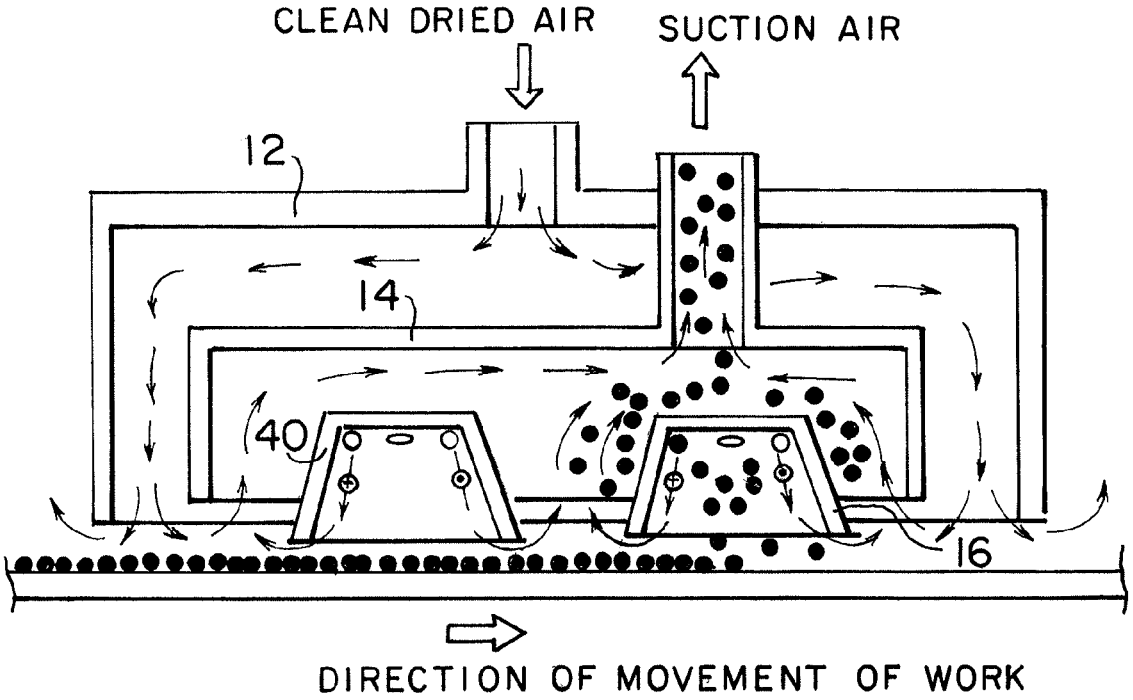
FIG. 7 is a view for explaining about the static eliminating and dust removing apparatus including the fourth embodiment of a drying machine disposed in front of the small container used in the static eliminating and dust removing apparatus.

The 4th embodiment will be explained with reference to FIG. 7. FIG. 7 shows a drying cup disposed for pre-processing. There is the problem of humidity when the dust is removed. To solve the problem, a drying step is prepared for pre-processing. Although it is preferable that the cup 40 for use in the drying step is of the same structure as the small container, the cup may be constructed so that the ultrasonic generator and the ion generator which are not directly related to the drying are not provided so as to reduce costs. By two steps of the drying and dust removal, high performance of static eliminating and dust removing apparatus can be obtained.

5th Embodiment

Figure 8A:
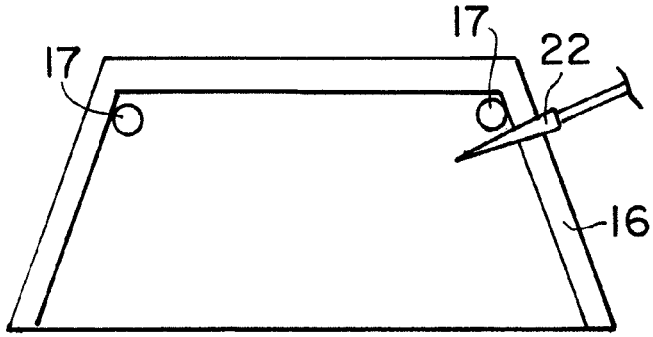
FIGS. 8A and 8B show alternate views for explaining about the disposition of the 5th embodiment of discharge needles.
Figure 8B:
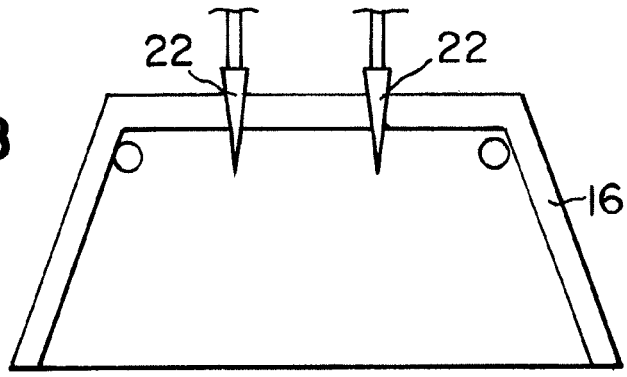

The 5th embodiment will be explained with reference to FIGS. 8A and 8B. Although in the first embodiment the discharge needles 22 are disposed above the small container 15 and outside thereof, in this embodiment the discharge needles 22 are attached to the side wall or upper wall of the small container. FIG. 8A shows the discharge needles 22 attached to the side wall of the small container and FIG. 8B shows the discharge needles 22 attached to the upper wall of the small container.

6th Embodiment

Figure 9:
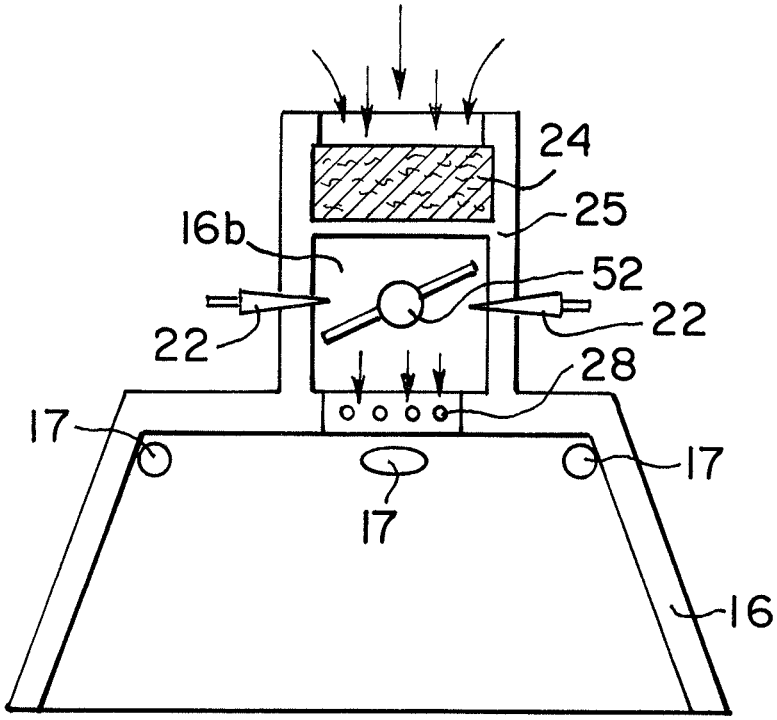
FIG. 9 is a view for explaining about the 6th embodiment of the valve for adjusting the volume of a clean dried air.

The 6th embodiment will be explained with reference to FIG. 9. In the embodiment a valve 52 is provided in the ion chamber 16*b* to adjust the volume of the supplied clean dried air.

7th Embodiment

Figure 10A:
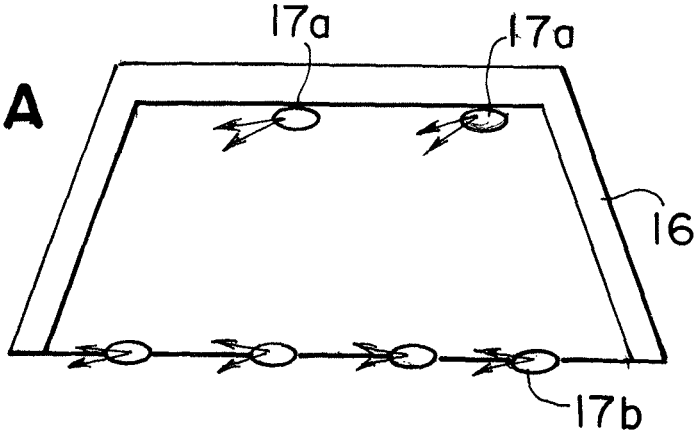
FIGS. 10A, 10B and 10C show alternate views for explaining about the disposition of 7th embodiment of air injection opening.
Figure 10B:
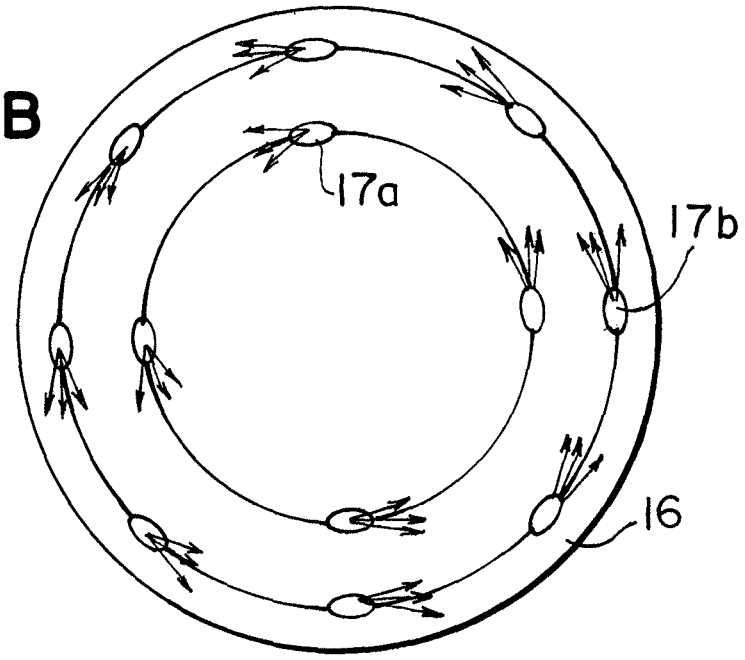
Figure 10C:
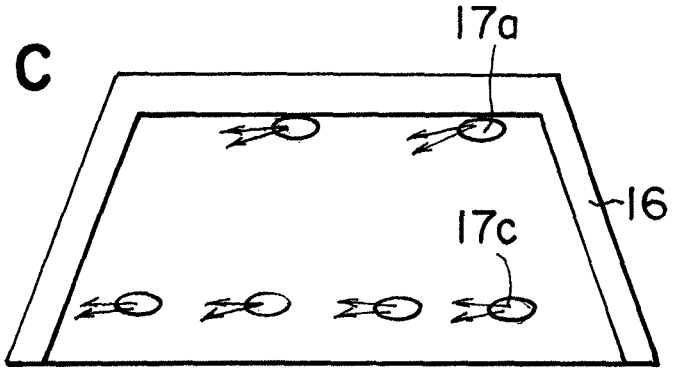

The 7th embodiment will be explained with reference to FIGS. 10A, 10B and 10C. Although in the first embodiment injection openings 17 (17*a*) are provided at the uppermost portion of inner wall of the small container, in this embodiment the injection openings 17*b* and/or 17*c* are provided at the bottom portion and/or the lower portion of the wall of the small container. The air injected into the small container through the injection opening 17*a* and 17*b* and/or 17*c* moves downward while circling along the inner wall of the small container. The circling downward air induces a downward air stream or cyclone in the small container which causes the air within the small container to circle. The cyclone generates the negative pressure at the central upper position of the small container. When the negative pressure becomes high, the tornado which is an upward circling air stream is induced and as a result the air is sucked in from the bottom opening of the small container. Thus, the work from which the dust is removed is lifted upwardly. FIGS. 10A and 10B shows a combination of injection openings 17*a* at the uppermost portion and injection opening 17*b* at the bottom portion, and FIG. 10*c* shows a combination of injection openings 17*a* at the uppermost portion and injection opening 17*c* at the lower portion. A combination of 17*a*, 17*b* and 17*c* is not shown.

The air streams injected through injection openings 17*b* at the bottom portion or injection openings 17*c* at lower portion have less friction against the wall, compared with the air stream injected into the injection openings 17*a* at the uppermost portion since the distance in which the air stream flows along the inner wall is shorter. Thus, since the loss of the speed of air stream is less, the dust removal can be made at high speed to enhance the dust removing effects.

8th Embodiment

Figure 11:
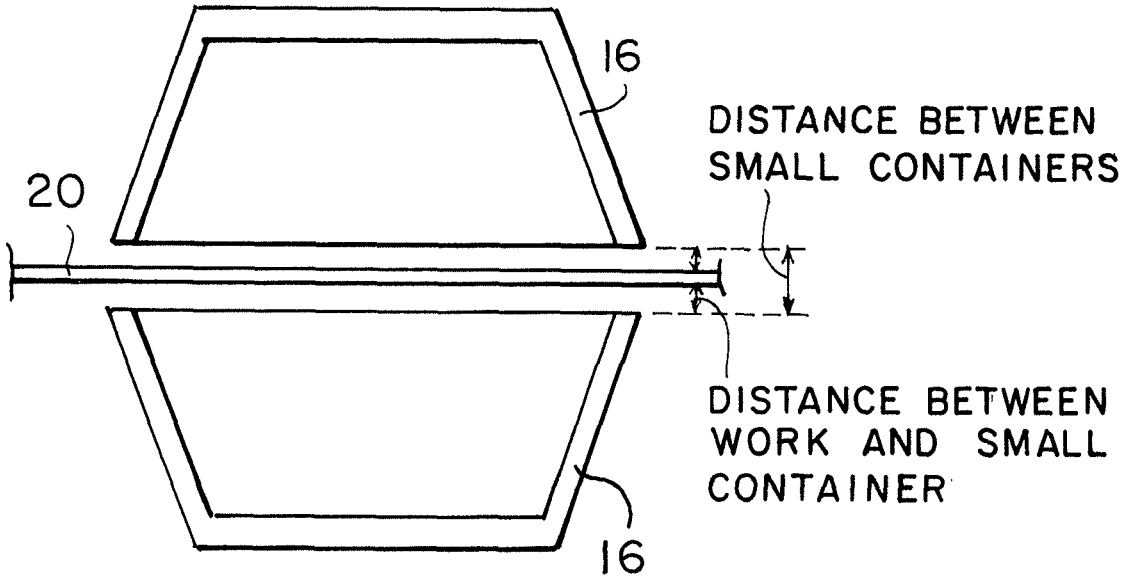
FIG. 11 is a view for explaining about the disposition of small containers in opposite position relative to the work.

The 8th embodiment will be explained with reference with to FIG. 11. In the embodiment small containers 16 are disposed at the opposite sides of the work 20, that is, front side and rear side of the work. Since the oppositely disposed small containers blow out the cyclone together around the openings of the small containers the work is pushed by the cyclone from the opposite sides. Thus, the distance between the work and one of the small containers is limited less than the distance between the small containers. Thus, if the volumes of both cyclones are selected to be the same, the distance between the work and the small container is maintained to be constant even if the volumes of cyclones increase. As a result performance of dust removal is enhanced.

9th Embodiment

Figure 12:
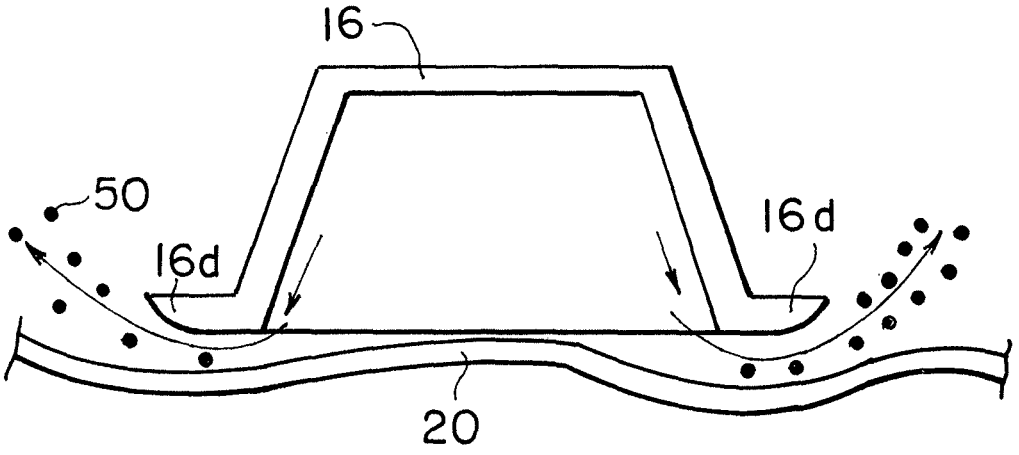
FIG. 12 is a view for showing the skirt portion in the airfoil form provided at the bottom portion of 9th embodiment of small container.

The 9th embodiment will be explained with reference to FIG. 12. FIG. 12 is a view for explanation on skirt portion provided at the bottom portion of the small container or cup. Although in the 2th embodiment shown in FIG. 2 the small container is provided with the skirt portion at the bottom portion of the small container, in the 9th embodiment the skirt portion 16*c* is transformed so that its front edge is of the wing form which is curved upwardly to become a skirt portion 16*d*. The wing form of skirt portion 16*d* lifts the air stream blown out from the small container in a horizontal direction and the dust included in the air stream. The lifted dust 50 can be easily collected by vacuum suction within the big container 14 (see FIG. 1) disposed out of the small container.

10th Embodiment

Figure 13:
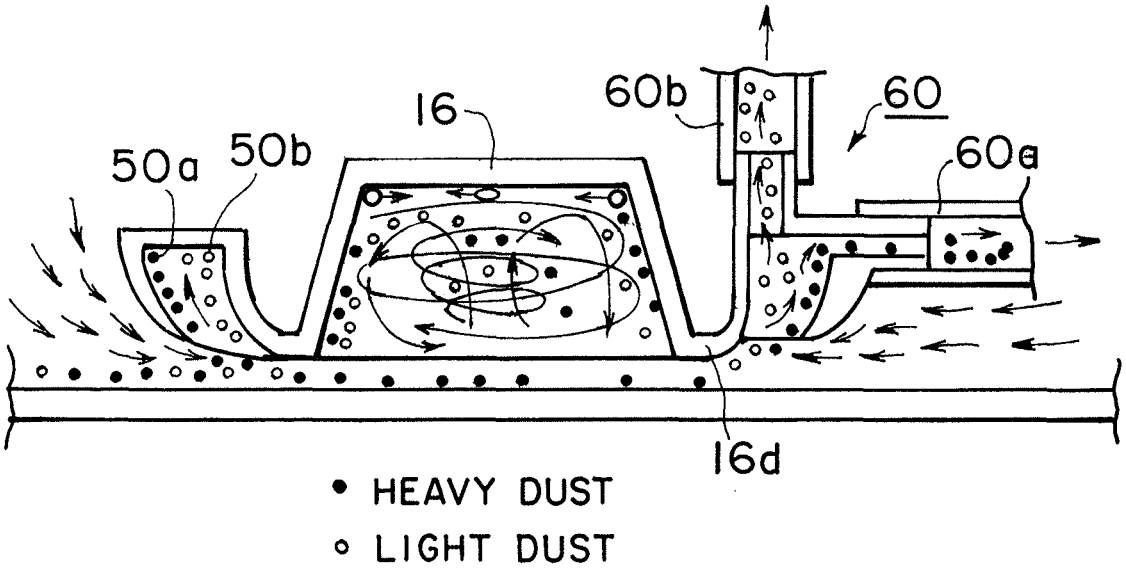
FIG. 13 is a view for showing 10th embodiment of dust collecting mechanism.

The 10th embodiment will be explained with reference to FIG. 13. FIG. 13 shows a collecting mechanism. The collecting mechanism 60 is concentrically disposed around the small container 16. The collecting mechanism 60 has a light dust collecting portion 60*b* at its inside and a heavy dust collection portion 60*a* at its outside. The dust 50 which is ripped from the work by the cyclone is lifted up along the wing form of skirt portion 16*d* and sucked into the collecting mechanism by the negative pressure while circling. Since the dust circles along the inner wall of the collecting mechanism the heavy dust 50*a* is affected by centrifugal force to be lifted along the outside wall and then collected through the heavy dust collecting portion. Since the heavy dust tends to drop down by force of gravity and attach to the work again, a strong negative pressure is used to prevent the dust from reattaching to the work. In the meanwhile, since the light dust 50*b* generates less force of gravity and thus floats in the air it can be easily collected by weak negative pressure through the light dust collecting portion 60*b* disposed inside of the heavy dust collecting portion 60*a*.

11th Embodiment

Figure 14:
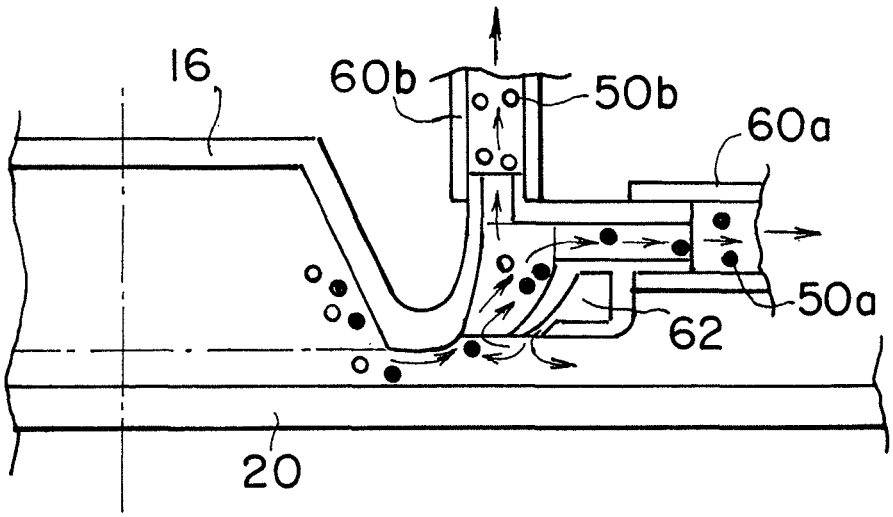
FIG. 14 is a view for showing 11th embodiment of construction for preventing dust from leaking outside.

The 11th embodiment will be explained with reference to FIG. 14. FIG. 14 shows use of barrier air. An air emitting portion 62 is provided to blow out or emit air toward the lowermost portion of the dust collecting mechanism so as to block out the cyclone including the dust and to prevent the cyclone blown out from the bottom portion of the small container from leaking out of the dust collecting mechanism.

12th Embodiment

Figure 15:
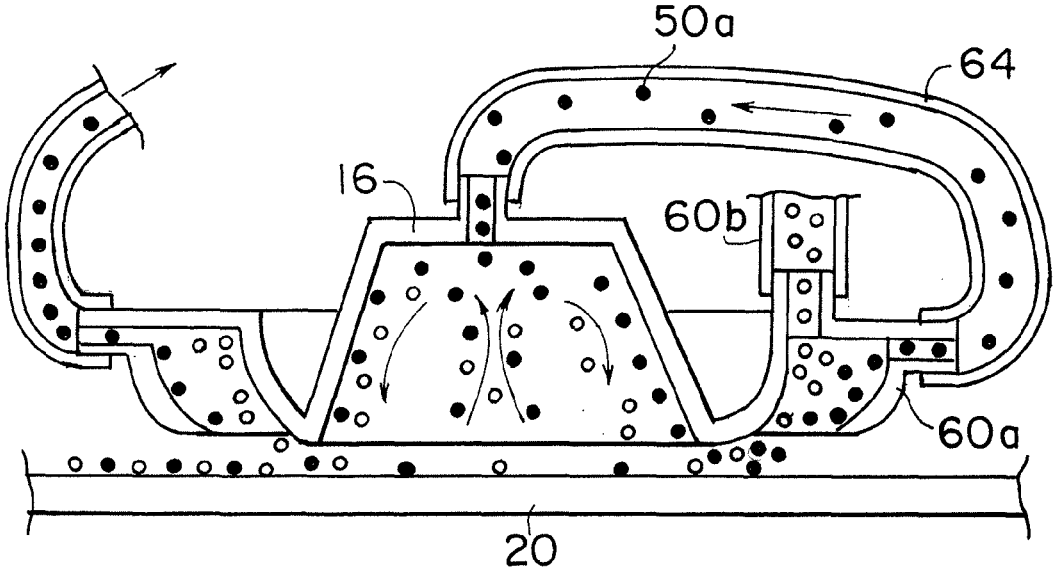
FIG. 15 is a view for showing 12th embodiment of the mechanism for reusing the collected dust.

The 12th embodiment will be explained with reference to FIG. 15. FIG. 15 shows a collected dust reusing mechanism. To separate the dust from the work, a portion of separated dust is returned to the small container and is again put into the cyclone to strike on the dust attached to the work. In that case, the heavy dust is mostly effective. That is, a portion of the heavy dust 50*a* is returned through a return tube 64 from the heavy dust collecting portion 60*a* to the small container 16.

13th Embodiment

Figure 16A:
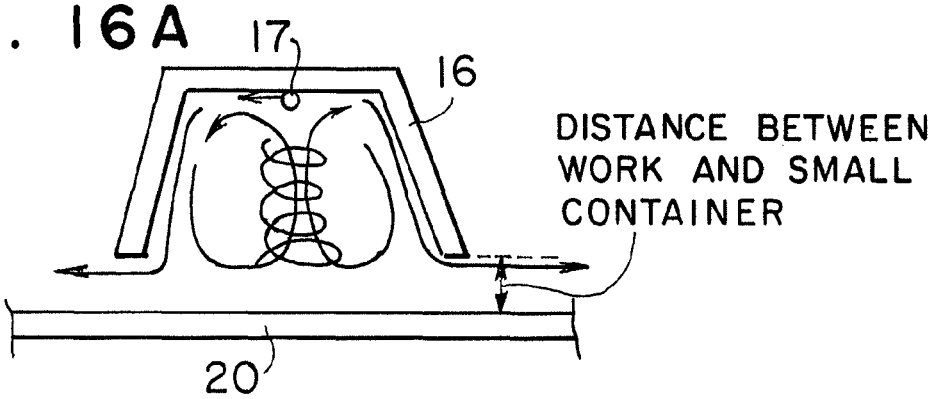
FIGS. 16A and 16B show alternate views for explaining about 13th embodiment of the construction for lengthening the distance between the small container and the work.
Figure 16B:
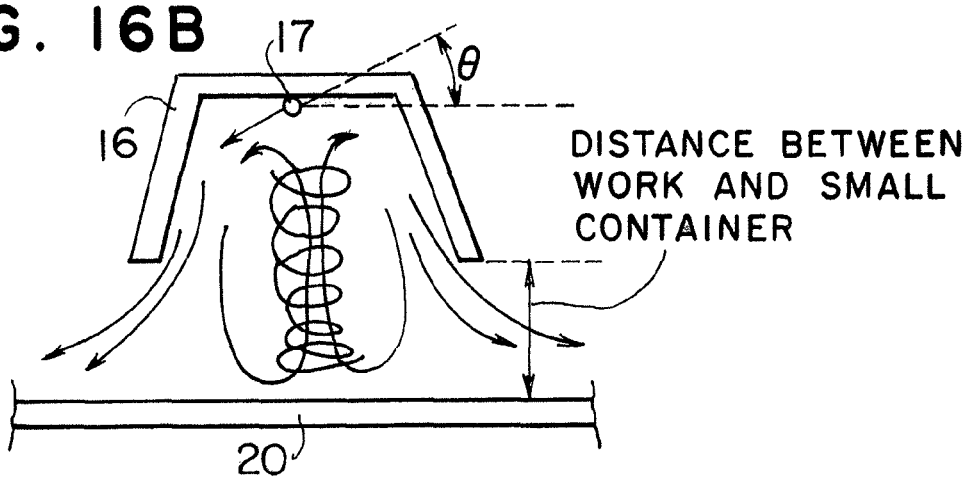

The 13th embodiment will be explained with reference to FIGS. 16A and 16B which show that the distance between the work and the bottom portion of the small container is caused to be extended. FIG. 16A shows horizontal incidence of air at injection opening 17 in the embodiment 1 for purpose of comparison, and FIG. 16B shows inclined incidence (angle of incidence: θ) in the embodiment 13. FIG. 16B shows the mechanism for extending the distance between the work 20 and the small container. The cyclone blown out from the upper portion of the small container goes down along the wall of the small container. The direction of cyclone blown out from the bottom portion of the small container depends on speed of downward flow. As the speed of downward flow is faster, the distance between the small container and the work is extended since the cyclone has more vertical component in the downward direction. Thus, the removal of the dust from the work which is away from the small container can be made.

14th Embodiment

Figure 17:
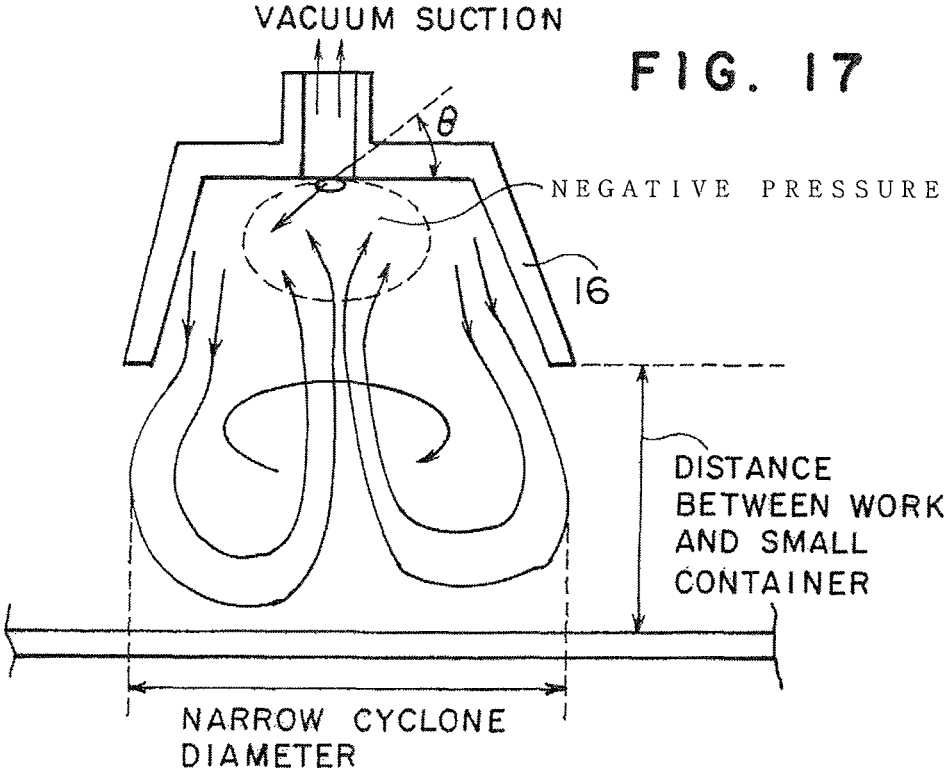
FIG. 17 is a view for showing 14th embodiment of construction for strengthening negative pressure within the small container.

The 14th embodiment will be explained with reference to FIG. 17. FIG. 17 shows the enhancement of the negative pressure. The cyclone generates the negative pressure within the small container, and the negative pressure induces the tornado. The negative pressure should be enhanced to enhance the tornado. For that purpose, the angle of incidence (θ) of air injected into the upper portion of the small container is caused to be larger. In the other way of enhancing the negative pressure, the air within the small container is sucked in at its uppermost portion by another source of vacuum suction. Thus, the work 20 is strongly sucked and the cyclone does not extend widely, and the distance between the work and the small container can be extended.

15th Embodiment

Figure 18:
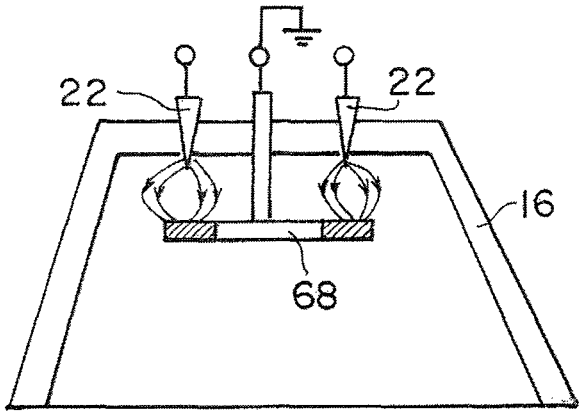
FIG. 18 is a view for showing 15th embodiment of construction for blocking electric field.

The 15th embodiment will be explained with reference to FIG. 18. FIG. 18 shows a mechanism for blocking electric field. To block the electric field emitted from the discharge needles 22 provided at the small container for generating air ions, an earth electrode 68 is provided below the discharge needles 22, The electric flux line going out from the needles 22 terminates at the earth electrode 68 to prevent the electric field from having an effect on the region below the earth electrode.

16th Embodiment

Figure 19A:
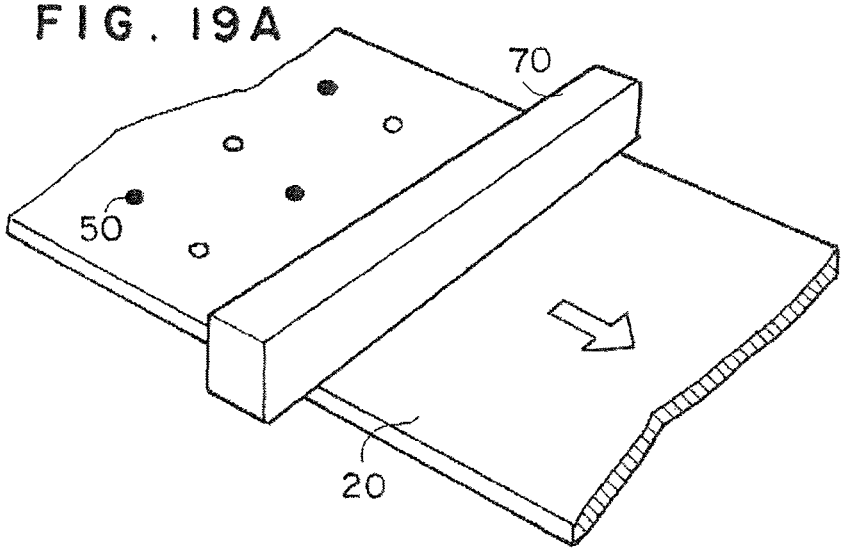
FIGS. 19A and 19B show alternate views for explaining about the phenomenon generated at both edges of the work in a direction of movement.
Figure 19B:
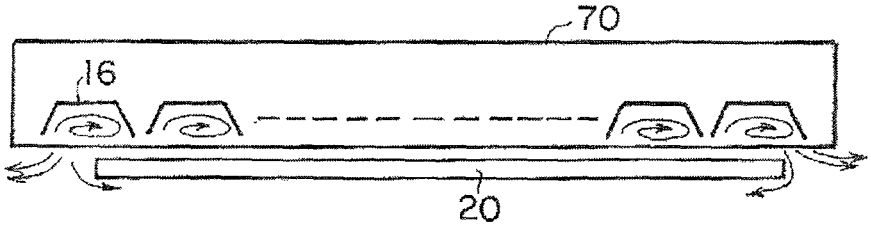

16th embodiment of a static eliminating apparatus 70 will be explained with reference to FIGS. 19A, 19B and 20. FIGS. 19A and 19B show phenomenon occurring on both edges of the work 20 in the direction of movement. FIG. 19A is a perspective view for showing the removal of dust 50 from the front surface of the work 20, and FIG. 19B is a cross-sectional view. Apparent from the cross-sectional view of FIG. 19B, the cyclone air stream goes around to the rear side of the work at both edges of the work. Since the cyclone includes the dust removed from the front surface, the dust would be attached on the rear surface of the work.

Figure 20:
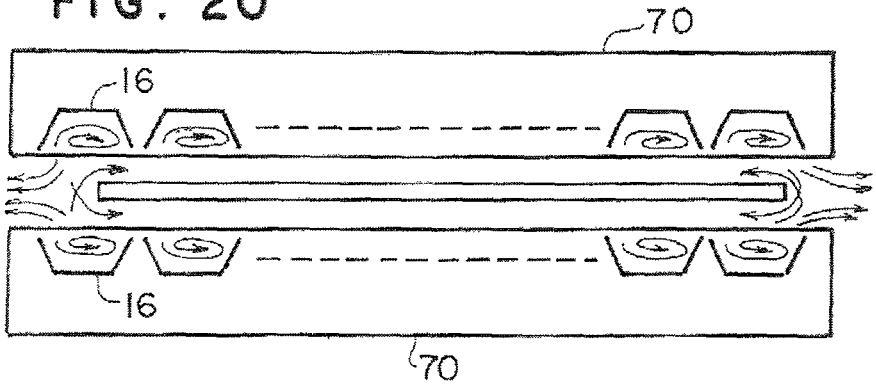
FIG. 20 is a view for the disposition of 16th embodiment of the static eliminating and dust removing apparatus for removing the dust from both sides of work.

FIG. 20 shows a static eliminating apparatus 70 with static eliminating and dust removing apparatuses disposed at both sides of the work 20 to completely remove the dust at the opposite edges of the work. In that case, the circling direction of cyclone air stream at the front side of the small container is the same as the circling direction of cyclone air stream at the rear side of the small container as viewed from one direction. That is, the circling direction of cyclone air stream at the front small container is opposite to the circling direction of cyclone air stream at the rear small container as viewed from back of each container. In the static eliminating and dust removing apparatuses in the 16th embodiment, small containers are disposed perpendicular to direction of movement of the work and/or may be disposed in many rows, not shown.

17th Embodiment

Figure 21:
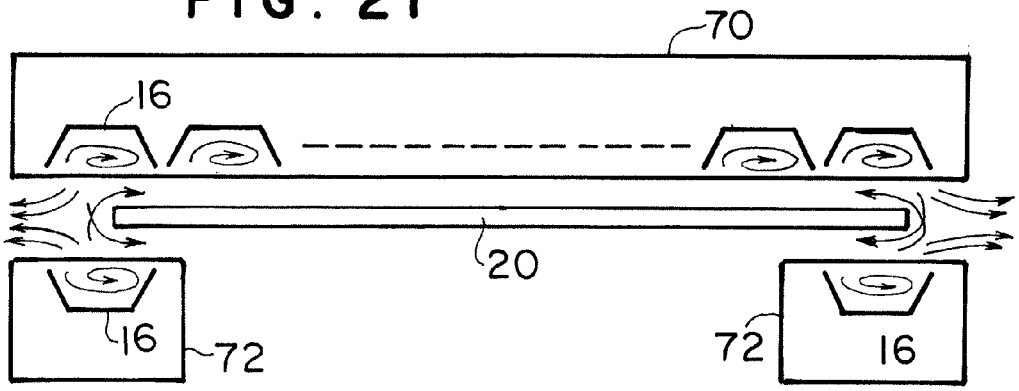
FIG. 21 is a view for showing 17th embodiment of an edge treatment cleaner.

FIG. 21 shows a method of treatment for removing the dust from one surface of the work 20 by a static eliminating apparatus 70. In the case of one surface treatment, edge treatment cleaners 72 are provided at both edges below the rear sides of the work to prevent the dust from the front side from attaching to the rear surface of the work. At that case, the circling direction of cyclone air stream of each of rear edge treatment cleaners is caused to be the same as the direction of cyclone air stream at front side as viewed from one direction.

18th Embodiment

Figure 22A:
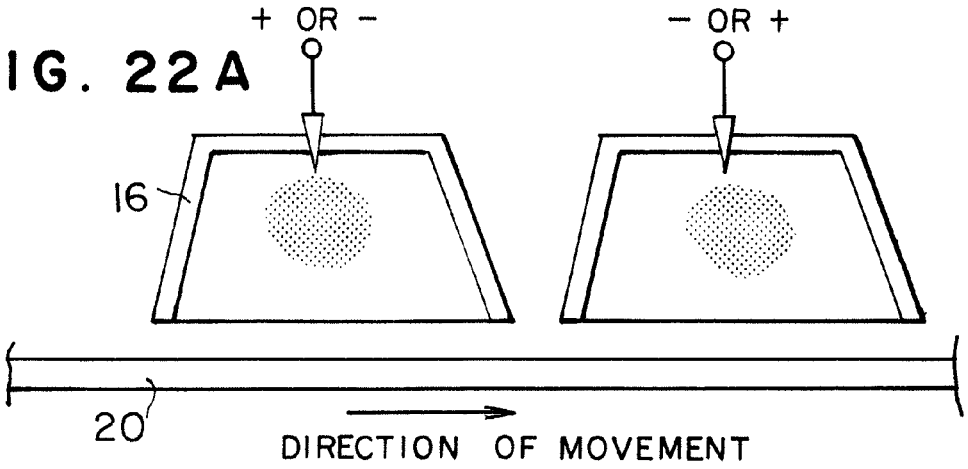
FIGS. 22A and 22B show alternate views for showing the disposition of 18th embodiment of small container and the applied polarities of ions.
Figure 22B:
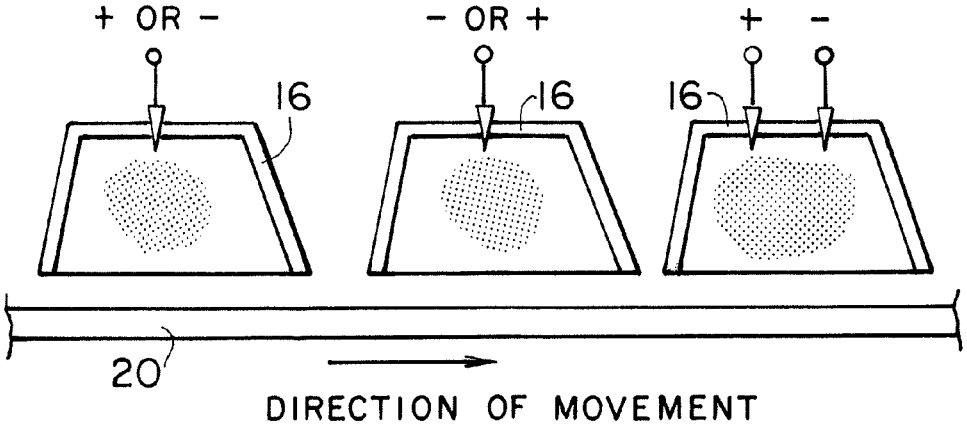

FIGS. 22A and 22B show a method of removing dust for use with electrostatic attraction. FIG. 22A shows a method of applying opposite polarities of air ion one after another. FIG. 22B shows a method of applying both polarities of +/− at the final stage. In the direction of movement of the work, a first small container is filled with one polarity of air ion and a next small container is filled with polarity of air ion opposite to that of first small container. Since there is the case that the work bears opposite polarity of electrostatic charge, the last small container is filled with both polarities of +/− to neutralize electrostatic charge.

In a case that the work is an insulator, when air ion is applied to the work, the charge state of the work does not change. The degree of removal of dust depends on the polarity of charge on the surface of the dust. That is, since the dust is easily removed by either of polarities of air ion, the dust is easily removed by applying + and − ion alternately at a time of either application of + and −. In the meanwhile, in a case that the work is a conductor, if air ion is applied, static induction occurs on the surface of the work and the polarity of charge opposite to air ion appears. Since that polarity of charge has a function of lifting the dust up, the dust is easily removed by applying + and − ion alternately at a time of either application of + and −.

In the case that the dielectric constant of the dust is big, the surface of the dust bears static by applied air ion, and as a result, the opposite surface of the dust induces polarization to be charged oppositely. Easy removal of dust depends on whether that opposite polarity of static enhances already charged static or offsets the same. Therefore, if at the previous step, one polarity of air ion is applied and then at the post step opposite polarity of air ion is applied, static is offset by either steps and at that time the dust is removed. In the case that the dielectric constant of the dust is small, the charge on the rear surface of the dust does not change. Since either polarity of air ion offsets the attraction by which the dust is attached to the work, and at that time the dust removed. In this manner, in either case, the dust is easily removed by applying ions of + and − alternately at either time. The dust removal treatment of cyclone and tornado stream at this timing enhances the performance for removing dust.

It is understood that many modifications and variations may be devised given the above description of the principles of the invention. It is intended that all such modifications and variations be considered as within the spirit and scope of this invention, as it is defined in the following claims.

The invention claimed is:

1. A static eliminating and dust removing apparatus which comprises:

a big container of relatively large air volume size having an opened bottom portion and an opened uppermost portion for sucking dust upwardly and discharging dust;

a small container of relatively small air volume size and of hollow cylindrical form or truncated conical form provided within said big container, said small container being constructed so that cyclone and tornado air movements are generated within said small container;

at least one ion generator disposed above or within said small container to supply ions; and said small container being provided with a plurality of compressed air injection openings through which a compressed air is injected into said small container to generate cyclone and tornado air movements within said small container, said plurality of compressed air injection openings further including at least one additional air injection opening spaced below said uppermost portion and located at at least one of (i) a bottom-most portion of said small container and (ii) a lower portion of said small container intermediate said uppermost and bottom-most portions.

2. A static eliminating and dust removing apparatus according to claim 1 which further comprises at least one ultrasonic wave generator disposed within or outside of said small container to impart vibrations to the dust attached to a work so as to separate the dust from the work.

3. A static eliminating and dust removing apparatus according to claim 1 in which said cyclone is generated so that it circles along the inner wall of said small container and induces an air stream discharged from the bottom portion of said small container in a horizontal direction to remove the dust from the work.

4. A static eliminating and dust removing apparatus according to claim 1 in which said tornado is generated at the central position within said small container to suck the dust upwardly from the work.

5. A static eliminating and dust removing apparatus according to claim 1 in which the direction of air injected through said compressed air injection openings is horizontal or diagonally downward.

6. A static eliminating and dust removing apparatus according to claim 1 in which vacuum suction is made through the upper portion of said small container to enhance the negative pressure.

* * * * *